US007413058B2

(12) United States Patent
Zappa

(10) Patent No.: US 7,413,058 B2
(45) Date of Patent: Aug. 19, 2008

(54) ACTIVE SLIDE FOR THE DOORS OF LIFTS' CABINS

(75) Inventor: Roberto Zappa, Bergamo (IT)

(73) Assignee: Sematic Italia S.p.A., Osio Sotto (Bergamo) (IT)

( * ) Notice: Subject to any disclaimer, the term of this patent is extended or adjusted under 35 U.S.C. 154(b) by 25 days.

(21) Appl. No.: 11/266,658

(22) Filed: Nov. 3, 2005

(65) Prior Publication Data

US 2006/0107785 A1 May 25, 2006

(30) Foreign Application Priority Data

Nov. 19, 2004 (IT) ..... MI2004A2249

(51) Int. Cl.
*B66B 13/12* (2006.01)

(52) U.S. Cl. ..... 187/319; 187/324; 187/331; 187/333

(58) Field of Classification Search ..... 187/319, 187/324, 331, 333
See application file for complete search history.

(56) References Cited

U.S. PATENT DOCUMENTS 1,842,806 A * 1/1932 Shonnard et al. ..... 187/319
3,405,782 A * 10/1968 Berkovitz et al. ..... 187/319
3,556,257 A * 1/1971 Caputo et al. ..... 187/319
3,783,977 A * 1/1974 Voser ..... 187/319
5,174,417 A * 12/1992 Pilsbury ..... 187/330
5,246,089 A * 9/1993 Husmann et al. ..... 187/319
6,164,417 A * 12/2000 Oberleitner ..... 187/319
6,173,815 B1 * 1/2001 Mittermayr ..... 187/330
6,340,073 B1 * 1/2002 Lee et al. ..... 187/309
7,100,745 B2 * 9/2006 Bisang et al. ..... 187/319

* cited by examiner

*Primary Examiner*—Patrick Mackey
*Assistant Examiner*—Terrell H Matthews
(74) *Attorney, Agent, or Firm*—Wolf, Block, Schorr & Solis-Cohen LLP

(57) ABSTRACT

An active slide (10) for doors of lifts' cabins, comprising a linearly developing blade, vertically oriented, featuring respective ends folded according to the same angle, connected in an articulated manner with a carriage (12) connected to a driving engine by means of a cogged belt (14) and a lever (16) through elastic means (20), said slide cooperating with a balancing hook (18) and an unlock lever (22); the unlock lever (22) is operatively connected to electrically activating means (24) provided with a cam (26) or the like for striking the free end of the lever itself.

4 Claims, 5 Drawing Sheets

ACTIVE SLIDE FOR THE DOORS OF LIFTS' CABINS

BACKGROUND OF THE INVENTION

The present invention relates to an active slide for the doors of lifts' cabins.

More particularly, the present invention relates to a slide for the doors of lift cabins specifically suited for being installed on high speed and/or long path systems.

DESCRIPTION OF THE PRIOR ART

It is known that lift systems comprise different safety devices, in order to guarantee a proper functioning and therefore put the users in a risk-free condition. Particular attention is dedicated, during the projecting of these systems, to the correct closing of the doors, which, in case of malfunctioning, might lead to serious dangerous situations. The devices provided for moving the doors, particularly the floor doors, traditionally comprise a slide for the coupling with the floor lock, cooperating with the so called cabin hook and with an unlock lever. This unlock lever is put in motion by means of cams and a fixed ramp leading it to the lowering or locking position. This procedure allows the closing of the slide, which is lifted and disengaged from the floor lock by the action of a traction belt connected to a conventional engine. Therefore the lowering of the unlock lever is the necessary condition for closing the slide.

The closing of the floor doors on high speed and/or long path systems was seen to be often difficult as a consequence of the pressure present inside the shaft where the cabin moves; this happens because the high speed movement of the cabin, which often exceeds 10 meter/second, rapidly moves the air inside the shaft causing the so called "chimney effect". The difficulties in the floor doors closing requires, in many cases, the intervention of the maintenance operators and anyhow it slows down the functioning of the lift system as a whole.

Another construction inconvenience that has been reported on high speed and or long path systems regards the blocking hook or cabin hook, which is traditionally connected to an automatic lever placed closed or in the vicinity of the coupling slide with the door lock. This known embodiment of the cabin hook implies the use of large areas, besides requiring the creation of a specific lever for its operation.

SUMMARY OF THE INVENTION

Object of the present invention is to avoid the previously mentioned inconveniences.

More particularly, the object of the present invention is to provide a slide for the cabin doors of lifts, particularly for high speed and long path systems, suited to guarantee the perfect closing of the floor doors under any condition.

Further object of the invention is to provide a slide for the cabin doors of lifts whose locking hook does not require the predisposition of a specific lever for its relative connection/operation and, consequently, allowing to significantly reduce the overall area required.

Further object of the invention is to put at the users' disposal a slide for lifts' cabin doors suited to guarantee a high safety level, resistance and reliability over time, so to be further easily and economically built.

According to the present invention, the previous and other objects resulting from the following description, will be reached by the slide for lifts' cabin doors comprising a linearly developing blade, vertically oriented, with ends angularly folded according to the same direction, connected in an articulated manner to a carriage engaged to a driving engine by means of a cogged belt and a lever through elastic means, said slide cooperating with a balancing hook and an unlock lever, wherein the unlock lever is connected to electrically activating means provided with a cam or similar means suited to strike the free end of the unlock lever itself.

BRIEF DESCRIPTION OF THE DRAWINGS

The construction and functional characteristics of the slide for lifts' cabin doors of the present invention will be better understood from the following detailed description, which relates to the appended drawings representing one of the preferred and not limitative embodiments and wherein.

DESCRIPTION OF THE PREFERRED EMBODIMENT

Figure 3:
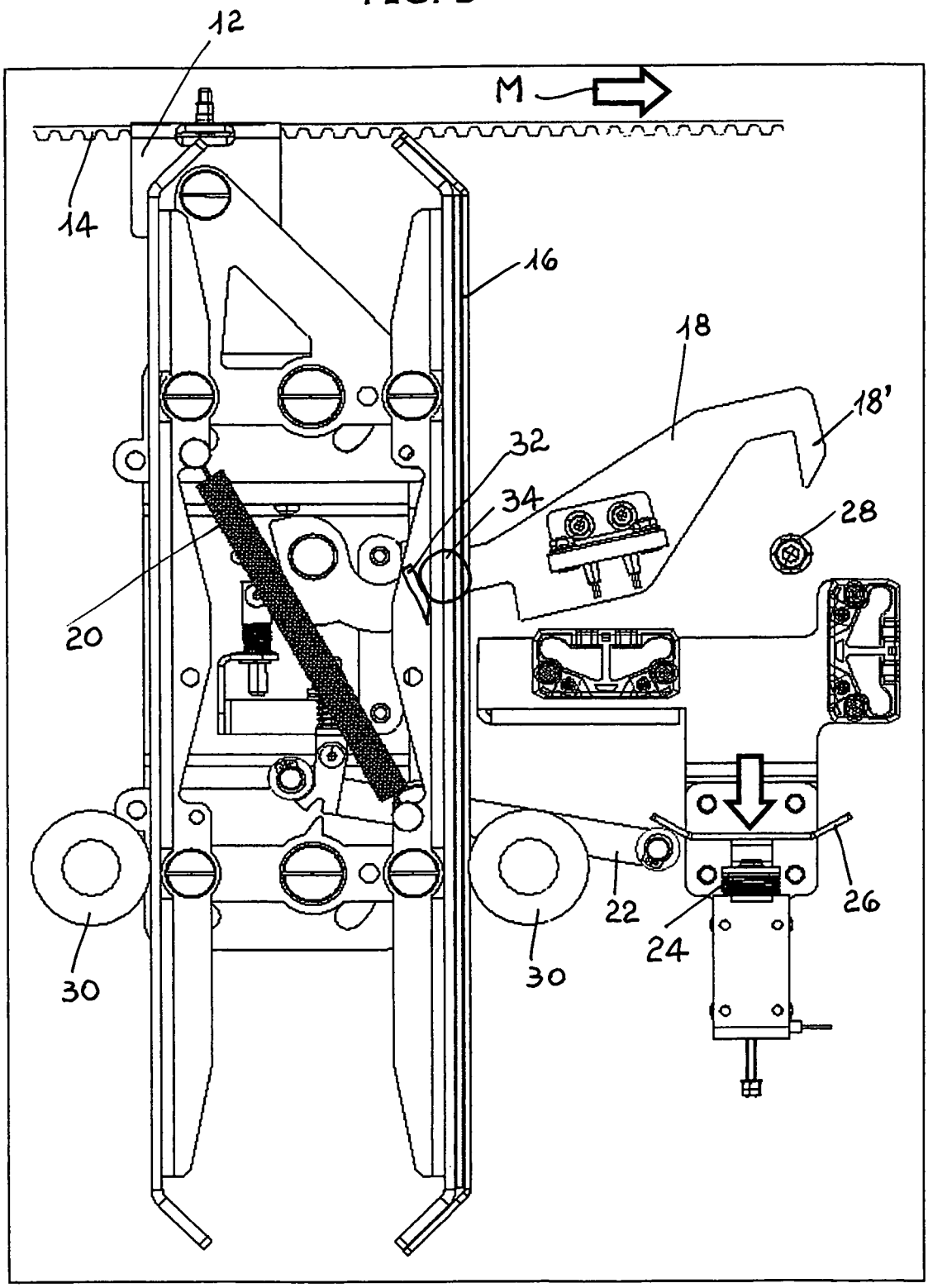
FIG. 3 represents the schematic view of the open slide, during the phase preceding its closing.
Figure 4:
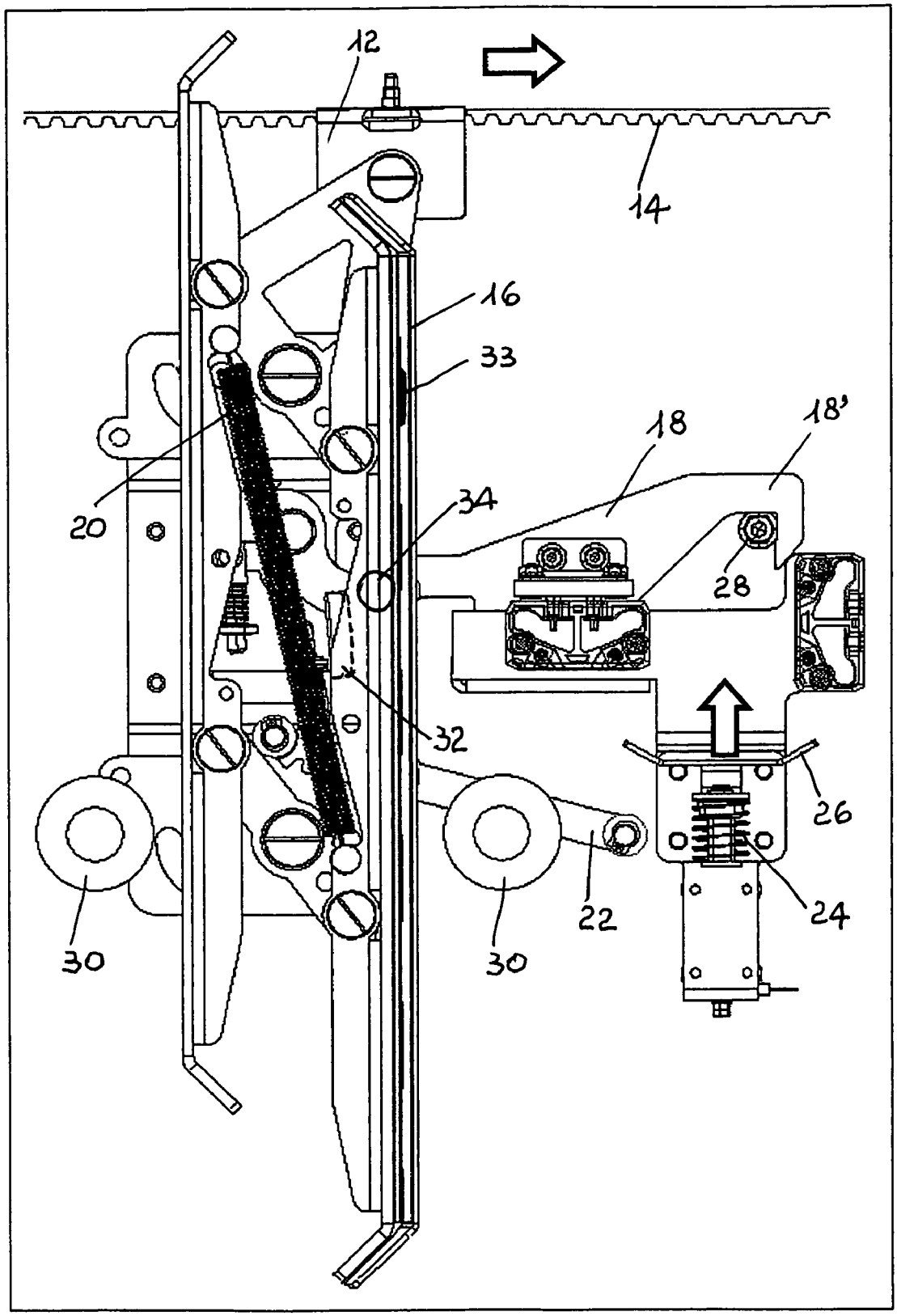
FIG. 4 represents the schematic view of the closed slide, with cabin door/s not coupled to floor door.
Figure 5:
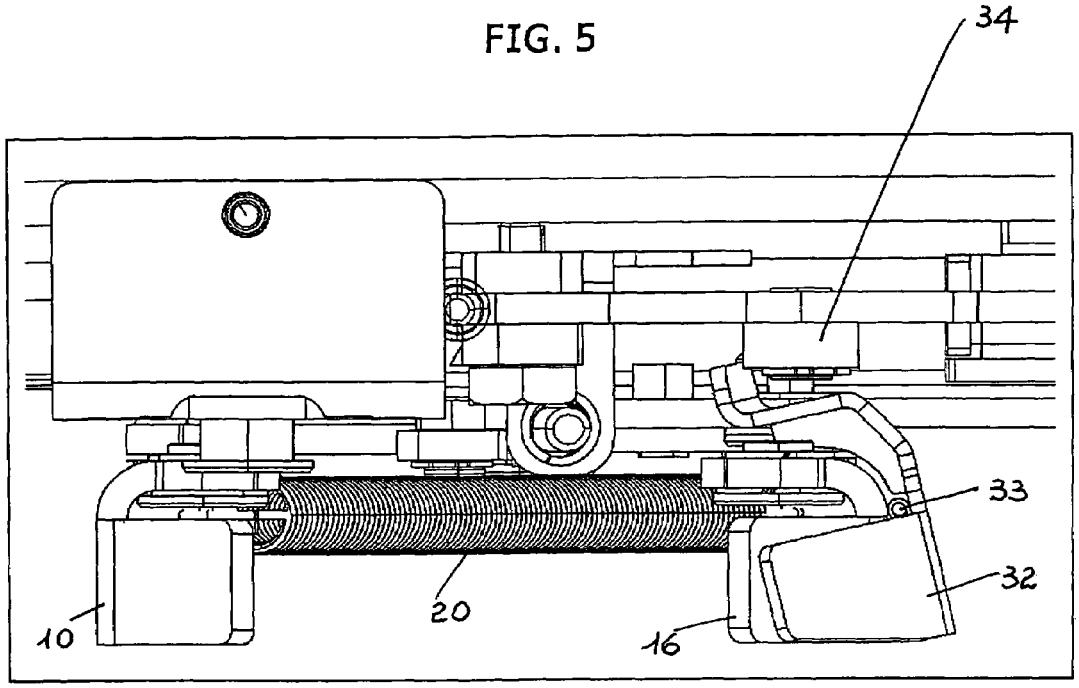
FIGS. 5 and 6 represent two schematic views from above respectively representing the unlock lever on resting and operation phases.
Figure 6:
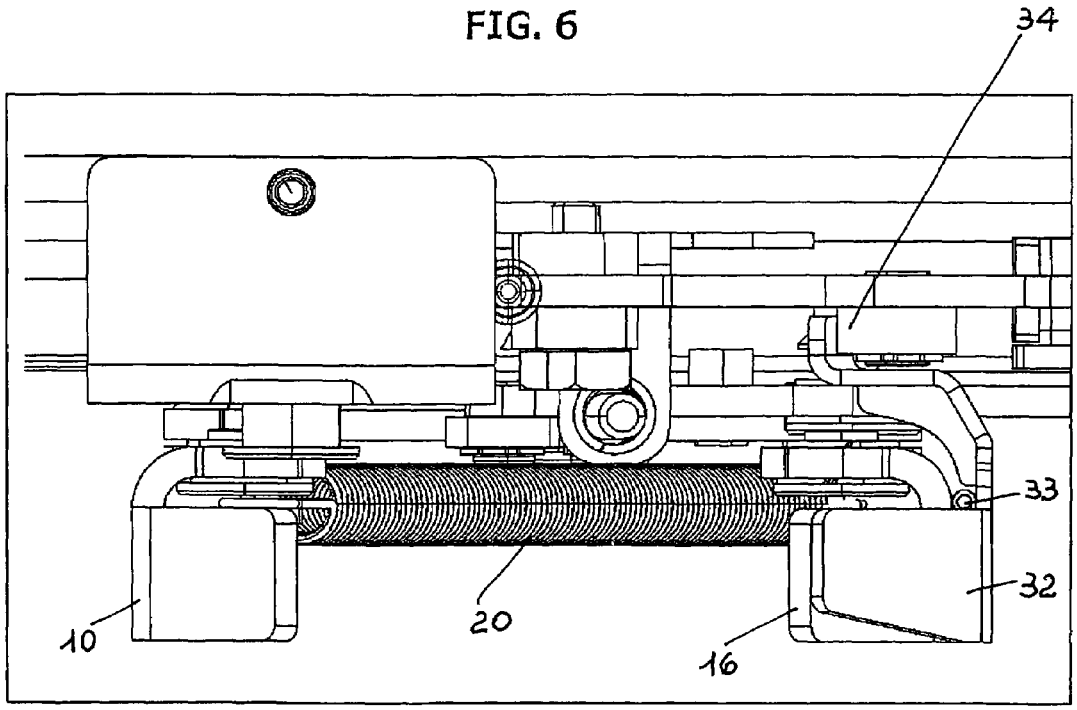

With reference to the above described drawings, the slide for lifts' cabin doors of the present invention is indicated with 10 in the contest of the partial schematic views described of the overall known systems commanding the movement of the doors themselves. Said slide 10, conventionally with a blade-like shape linearly developing, vertically oriented and with ends angularly folded in the same direction, is connected in an articulated manner to a carriage 12, engaged through a cogged belt 14 or similar means with a conventional driving linear movement engine, indicated by arrow "M" of FIG. 3. A similar blade or lever 16 is placed facing and opposed to slide 10 in order to activate the balancing hook of the cabin or blocking hook, schematically indicated with 18.

Slide 10 and lever 16 are put in elastic tension by means of a coil spring 20.

A second lever or unlock lever 22 is cinematically connected to lever 16.

According to the present invention, the unlock lever 22 is operatively connected to electrically activating means 24, provided with a cam 26 suited to strike the free end of lever 22 itself, as schematically represented in the FIGS. from 1 to 3. Said electrically activating means 24 generate a magnetic field and, preferably, comprise a coil. During the initial phase, as illustrated in FIG. 1, slide 10 is open, i.e. lifted and the cabin door is not coupled to floor door.

Cabin and floor doors are closed and cam 26 of coil 24 strikes unlock lever 22 which is oriented according to the horizontal direction and is substantially perpendicular to slide 10. In this condition the balancing hook of cabin 18 is closed since its spike shaped end 18' strikes a prominence 28 protruding from the sliding carriage of the doors.

Figure 1:
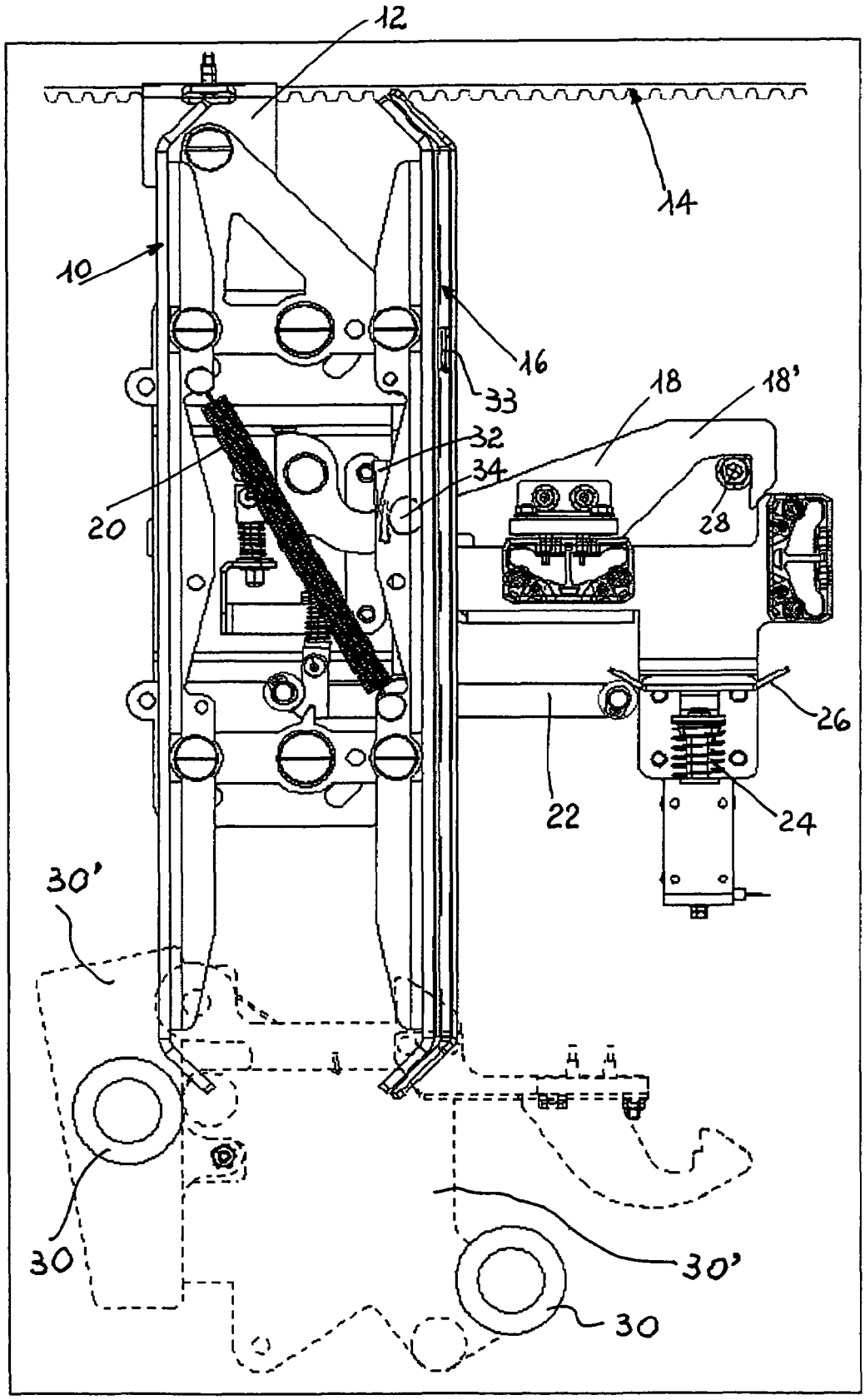
FIG. 1 represents a schematic frontal view of the slide for lifts' cabin doors of the present invention under opening condition, with cabin door/s not coupled to the floor door and with both cabin and floor doors closed.
Figure 2:
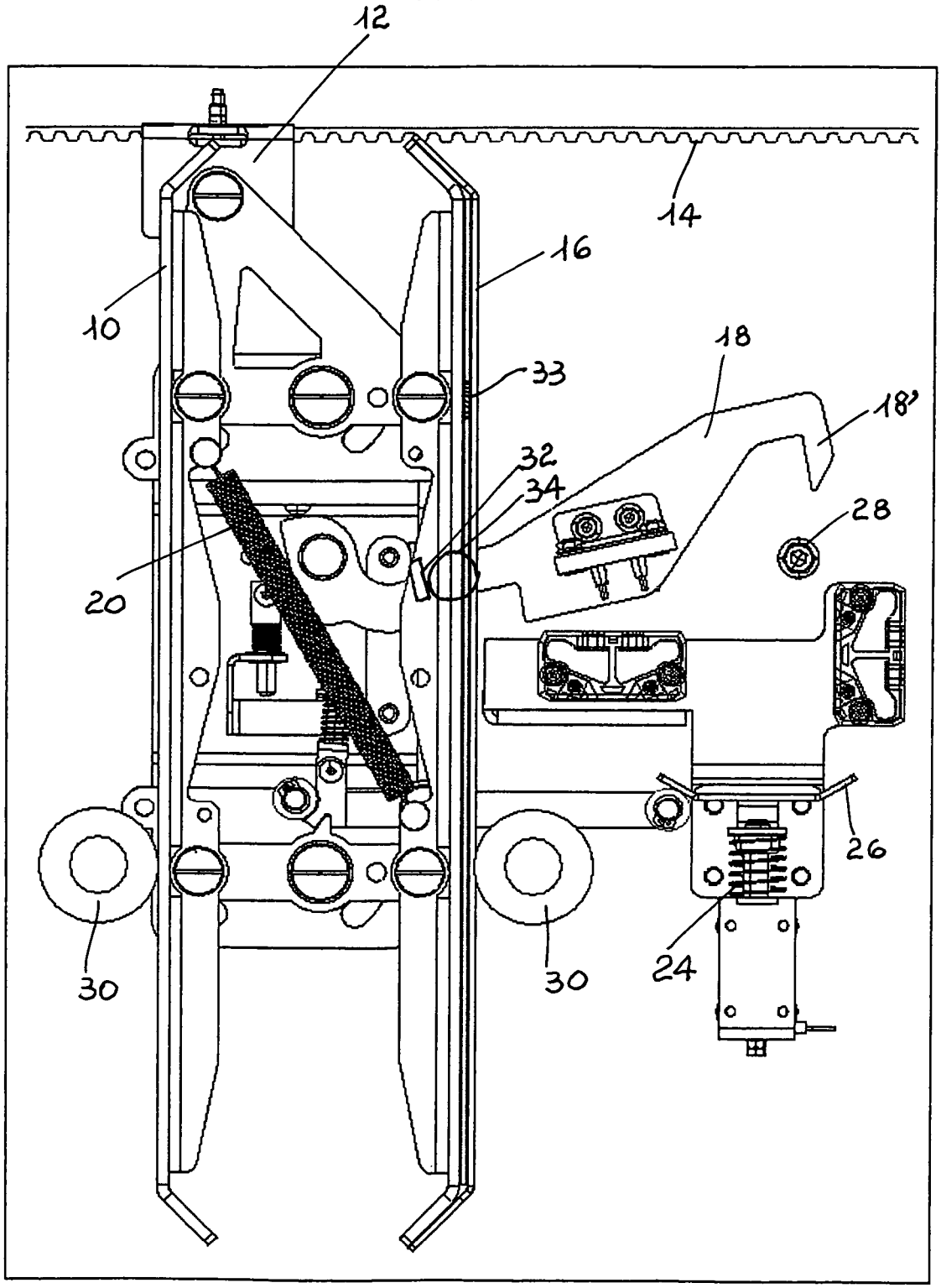
FIG. 2 represents a schematic view of the same slide of FIG. 1 under the opening condition, with cabin door/s coupled to the floor door.

Once cabin door is coupled to floor door (FIG. 2), and slide 10 and lever 16 strike conventional coupling wheels 30 of floor lock, schematically dashed and indicated with 30' in FIG. 1; lever 16 connected to balancing hook of cabin 18 is activated and the latter is open, that is disengaged from prominence 28.

Cam 26 of coil 24 strikes unlock lever 22 as seen during the previous phase. Coil 24, electrically powered in a known manner, e.g. by cabin controller, is then activated in order to ease the lowering of unlock lever 22 and allows the closing of the slide 10, as in FIG. 3. Cam 26 lowers and pushes lever 22 which angularly positions itself downward, while the balancing hook of cabin 18 stays open. During this phase, driving engine is activated providing, by means of belt 14, the closing of the slide. The following operative phase implies the decoupling between cabin door and floor door, release of coil 24 with following disengagement between cam 26 and unlock lever 22 and closing of balancing hook of cabin 18 whose end 18' moves back to engage with prominence 28. The intervention of coil 24 with its relative cam 26 substantially eases the closing of slide 10 under any condition, also in presence of high air pressure inside the lift shaft, and determines, as a consequence, the precise and rapid closing of floor doors.

The balancing hook of cabin 18 is innovatively connected to lever 16 by means of a blade 32 provided with a hinge 33 constrained to lever 16 itself in a known manner. Said blade 32 is free and engaged by means of wheel 34 when slide 10 moves from closing to opening position.

Once blade 32 rotates on hinge 33 as a consequence of being restrained between wheels 30 of floor lock, the blade itself hooks wheel 34 which is mounted on balancing hook of cabin 18 and, pushing on the wheel itself, opens said hook.

As can be seen from what is previously reported, numerous are the advantages achieved by the invention.

The slide of the present invention guarantees, thanks to the presence of coil 24, the rapid and precise closing of slide 10 and, as a consequence, of floor doors under any condition. Besides the absence of any slowing down during the functioning of the system, traditional and frequent maintenance interventions and consequent disadvantages for users can be avoided. Blocking hook or balancing hook of cabin 18, allows, for being operatively connected to lever 16, to significantly reduce the overall area necessary since it excludes the use of an automatic activation lever.

Although the invention has been previously described with particular reference to one embodiment, solely given as a non limitative example, numerous modifications and variants will become evident to a person skilled in the art on the base of the above reported description. The present invention, therefore, intends to embrace all the modifications and variants falling within the spirit of the following claims.

The invention claimed is:

1. An active slide for the door of a lift cabin, comprising a linearly developing blade, vertically oriented, with ends angled in the same direction, connected in an articulated manner to a carriage engaged with a driving engine by means of a cogged belt and a lever through elastic means, said slide cooperating with a balancing hook and an unlock lever having a free end, wherein the unlock lever is operatively connected to electrically activating means provided with a cam suited to strike the free end of the unlock lever, and wherein, when the slide is open and when the cabin door is coupled to the floor door, both said cabin and floor doors are closed, and the cam of the coil subsequently strikes the free end of the unlock lever, which is lowered, activating the coil, thus opening the balancing hook and activating the driving engine, resulting in the closing of the slide.

2. The slide according to claim 1, wherein the electrically activating means operatively connected to the unlock lever comprises a coil.

3. The slide according to claim 1, wherein the balancing hook is connected to the lever by means of a blade provided with a hinge restrained to the lever, said blade itself engaging a wheel in the moment said slide is moved from closing position to opening position.

4. The slide according to claim 1, wherein the balancing hook comprises one end shaped as a spike, destined to engage with a member protruding from the sliding carriage of the doors.

* * * * *